US010107018B2

(12) United States Patent
Svenson

(10) Patent No.: US 10,107,018 B2
(45) Date of Patent: Oct. 23, 2018

(54) LOCKING POST WITH AN ADJUSTABLE LOCK ROD

(71) Applicant: Julian Michael Svenson, Cornwall (CA)

(72) Inventor: Julian Michael Svenson, Cornwall (CA)

(73) Assignee: Dynamic Closures Corporation, Long Sault (CA)

( * ) Notice: Subject to any disclaimer, the term of this patent is extended or adjusted under 35 U.S.C. 154(b) by 590 days.

(21) Appl. No.: 14/544,832

(22) Filed: Feb. 24, 2015

(65) Prior Publication Data

US 2016/0245002 A1 Aug. 25, 2016

(30) Foreign Application Priority Data

Feb. 23, 2015 (CA) ..... 2883182

(51) Int. Cl.
*E05C 1/12* (2006.01)
*E05C 9/04* (2006.01)
*E05B 65/00* (2006.01)

(52) U.S. Cl.
CPC ..... *E05C 9/04* (2013.01); *E05B 65/0085* (2013.01)

(58) Field of Classification Search
CPC .. E05B 63/20; E05B 65/1013; E05B 65/1006; E05C 7/06; Y10S 292/21; Y10S 292/15; Y10S 292/26
USPC ..... 292/114
See application file for complete search history.

(56) References Cited

U.S. PATENT DOCUMENTS 536,957 A * 4/1895 Klien ..... E05B 59/00 70/109
2,719,048 A * 9/1955 Hayes ..... E05B 65/1066 292/198
3,333,878 A * 8/1967 Pelcin ..... E05C 9/043 292/150
4,315,648 A 2/1982 Labelle
4,694,669 A * 9/1987 Schwalb ..... E05C 1/04 292/179
4,944,169 A * 7/1990 Labelle ..... E05C 1/04 292/179
5,603,534 A * 2/1997 Fuller ..... E05B 55/005 292/2
5,620,216 A * 4/1997 Fuller ..... E05B 55/00 292/142

(Continued)

*Primary Examiner* — Mark A Williams
(74) *Attorney, Agent, or Firm* — George A. Seaby

(57) ABSTRACT

A locking post for a closure having a locking unit in the middle of the post. The locking unit carries a latch movable transversely of the post between locked and unlocked positions. A bottom lock rod unit is slidably mounted in the bottom part of the post. The lock rod unit has a moving block, a lock rod extending from the bottom end of the moving block, and a rigid strap extending from the top end of the moving block to the locking unit and past the latch. The lock rod unit is movable within the post to move the lock rod from an unlocked position within the post out of the bottom end of the post to a locked position and to move the strap down past the latch. The latch on the locking unit is movable transversely of the post to a locked position in the path of movement of the strap to prevent the strap from returning to is unlocked position. An adjustable connection connects the strap to its moving block in a manner to be able to adjust the length of the lock rod unit.

9 Claims, 6 Drawing Sheets

(56) References Cited

U.S. PATENT DOCUMENTS

| | | | | |
|---|---|---|---|---|
| 5,901,989 | A * | 5/1999 | Becken | E05C 7/06 292/35 |
| 6,217,087 | B1 * | 4/2001 | Fuller | E05B 55/00 292/33 |
| 9,428,940 | B1 * | 8/2016 | Patrick | E05B 63/14 |

* cited by examiner

LOCKING POST WITH AN ADJUSTABLE LOCK ROD

FIELD OF THE INVENTION

This invention relates to a locking post for use on a folding closure.

BACKGROUND ART

Typically, a folding closure has one section which unfolds from one side of an opening to closure the opening or two sections which unfolds from opposite sides of the opening. The free end of each section has a locking post that locks the section in the unfolded, closed position. One manner of locking the post in the closed position is to provide a lock bolt slidable in the bottom of the post for movement out of the post to enter a hole in the floor. Usually a second lock rod is also provided in the top of the post for movement out from the post into a hole in the top of the opening.

The closure sections are suspended by trolleys from an overhead rail in the opening and have a small clearance from the floor when moved between open and closed positions. The lock bolts usually extend a predetermined length from the end of the locking post when in the locked position. The extended length is normally sufficient to insert the rod deep enough into the hole in the floor that it cannot be removed by lifting the post.

When installing the closure, it is often found that the floor and/or the top of the opening are not level. For example, the area where the locking post is located when the closure section is open may be lower than the surrounding floor. The difference may result in the lock bolt not extending sufficiently into the opening to securely lock the section.

To overcome the problem of uneven floors, it has been known to thread the lock bolt in a lock bolt unit in the bottom of the post and use an adjustment nut to change the distance the rod extends out of the end of the post. The nut is fixed in position but can be rotated in either direction to raise or lower the bolt. Thus the distance the lock bolt extends from the end of the post can be adjusted. An example of such an adjustment arrangement is shown in U.S. Pat. No. 4,944,169, issued to Robert Labelle. However, it can be difficult to rotate the adjustment nut to adjust the distance the bolt extends out of the end of the post because of space limitations. In accordance with the present invention, a lock bolt unit is provided, the length of which can be adjusted without having to adjust the lock bolt. The present invention further provides guide means for the lock bolt unit making it easier to install and to operate.

SUMMARY OF THE INVENTION

In one aspect, the present invention provides a locking post for use on a free end of a folding closure section comprising:

a tubular body having an inner wall, an outer wall and side walls extending between the inner and outer walls;

a bottom bolt lock assembly including a bottom lock operator slidable vertically in a bottom end of the tubular body, a handle connected to the operator and extending out of the inner or outer wall of the tubular body permitting manual movement of the operator, and a bolt extending downwardly from the operator for movement with the operator between a retracted position in the tubular body and an extended position into a hole in a floor beneath the closure section to lock the closure section in a closed, locked position, and a first spring on said bolt beneath said operator biasing the bolt to the extended position; and a latch unit in the tubular body for releasably latching the bolt in the extended position including a housing fixedly mounted in the tubular body above the bottom lock operator, a latch plate connected to one side of said operator and extending upwardly therefrom to a location beside said housing, a bar slidable in said housing between an extended position in which in blocks a path of travel of said latch plate when the operator is moved downwardly with the bolt to a locked position thereby preventing vertical movement of the bolt out of the locked position, a cylinder lock extending through said inner or outer wall of the tubular body into said housing and a finger on said lock in the housing for retracting said bar to release the latch plate, permitting the spring to return the operator and bolt to the unlocked position.

BRIEF DESCRIPTION OF THE DRAWINGS

With reference to FIG. 1, the locking post indicated generally at 1 of the present invention is part of a folding closure assembly. The post 1 is connected to the free end 2 of a folding closure section 3, which closes part of an opening 4 in the wall 5 of a building. The closure section 3 includes a plurality of hingedly interconnected panels 7. The post 1 and the panels 7 are suspended from a rail 8 at the top of the opening 4 by trolleys 9 mounted in the top end of the post 1 and the panels 7. The other end 10 of the closure section 3 is fastened to one side 12 of the opening 4. When the closure section 3 is unfolded to the closed position shown in FIG. 1, the post 1 is located above a hole 13 in the floor 14 of the building, and a bolt 16 (FIG. 2) is moved downwardly into the hole 13 to lock the closure section 3 in the closed position. A second similar closure section (not shown) is attached to the other side 17 of the opening 4 and locked to the closure section 3, completely closing the opening 4.

Referring to FIGS. 2 and 4, the locking post 1 includes a tubular body 19 defined by an inner wall 20, an outer wall 21 and side walls 23 and 24 interconnecting the ends of the inner and outer walls 20 and 21, respectively. The inner wall 20 is considered to define the side of the post 1 facing the area closed off by the folding enclosure, and the outer wall 21 is the side of the post facing away from such area.

Figure 1:
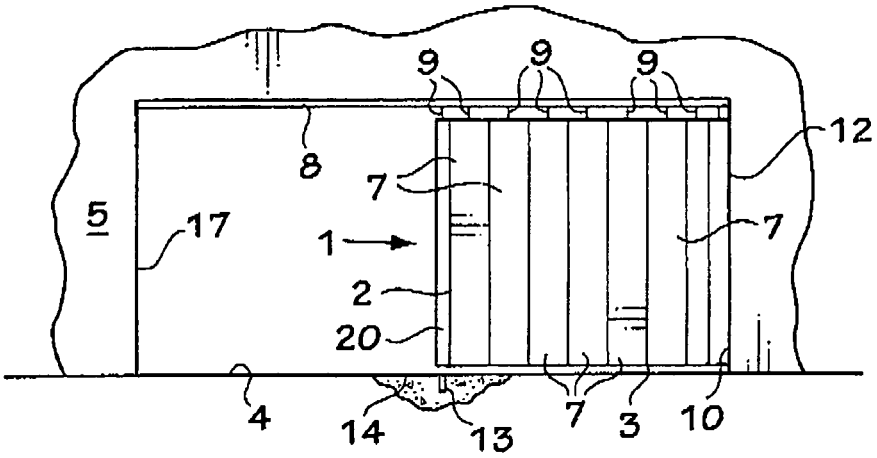
FIG. 1 is a front view of one section of a folding closure.

The inner and outer walls 20 and 21 are mirror images of each other. Each of the walls 20 and 21 includes a central, longitudinally extending channel 26 for receiving the fingers of a person opening or closing the door section 3. The ends 27 of the walls 20 and 21, respectively bend inwardly towards each other and include longitudinally extending, generally J-shaped recesses 29 and 30 for receiving the ends 31 and 32 of the side walls 23 and 24. The C-shaped end 31 of each side wall 23 and 24 is hooked into the recess 29, and the other, inwardly bent end 32 of each side wall is rotated into the recess 30 and secured therein by longitudinally spaced apart screws 34 (one shown on each side).

Figure 2:
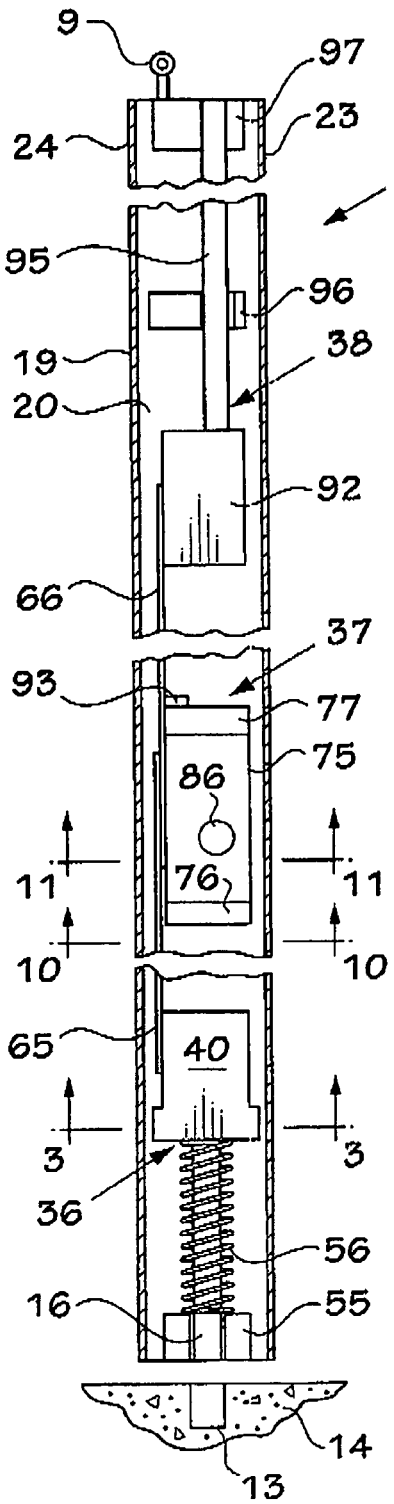
FIG. 2 is a schematic, longitudinal section view of a locking post in accordance with the present invention.
Figure 3:
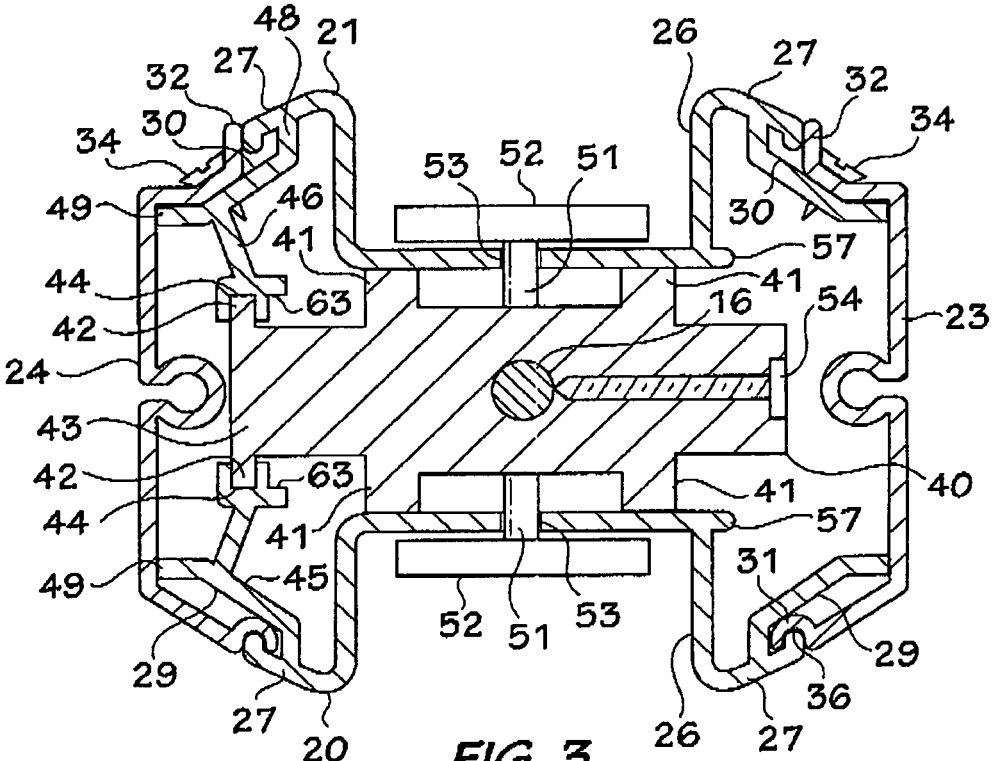
FIG. 3 is a cross section of the locking post taken generally along line 3-3 of FIG. 2 with all walls in position.

The post 1 contains a bottom bolt lock assembly, a central latch unit and a top bolt lock assembly indicated generally at 36, 37 and 38, respectively. As best shown in FIGS. 2 and 3, the bolt lock assembly 36 includes a bottom operator 40 defined by a block slidable in the tubular body 19 of post 1. For such purpose, the operator 40 includes flanges 41 extending outwardly into sliding engagement with the front and rear walls 20 and 21 of the post body 19. Longitudinally extending flanges 42 on one narrow end 43 of the operator are slidable in tracks 44 on the ends of opposed partial partitions 45 and 46 extending inwardly from the inner and outer walls 20 and 21, respectively of the post body 19. The partial partitions 45 and 46 are generally chair-shaped in cross section and include legs 48 integral with and extending inwardly from the front and rear walls, and a second leg 49 extending outwardly into contact with the side wall 24. Stems 51 of a T-shaped handles 52 extend outwardly from the inner and outer sides of the operator 40 through longitudinally extending slots 53 in the inner sides of the channels 26 for manually sliding the operator and the bolt 16 in post to the locked position.

Figure 4:
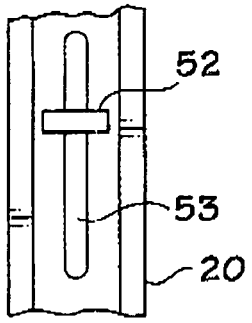
FIG. 4 is a front view of the bottom portion of the inner wall of the locking post.

The bolt 16 (FIGS. 2 and 3) is mounted in and extends downwardly from the bottom of the operator 40. The bolt 16 is retained in the operator 40 by a fastener 54 (FIG. 3). The bolt 16 is slidable in a bottom spacer 55 fixedly mounted in and closing the bottom of the post 1. A helical compression spring 56 on the bolt 16 and the operator 40 biases the bolt and operator to an upper, bolt retracted, position shown in FIG. 2. As shown in FIG. 4, the spacer 55 is a solid block with a hole 56 through its center for receiving the bolt 16. Hook-shaped flanges 57 on one end of the spacer 55 engage straight flanges 59 extending outwardly from the inner sides of the channels 26. Arcuate flanges 60 extend outwardly from the other end of the spacer 55 and are secured to the partial partitions 45 and 46 extending inwardly from the ends of the inner and outer walls 20 and 21. The flanges 60 are connected to the partial partitions 45 and 46 by screws 61. The opposed inner ends of the partial partitions 45 and 46 are F-shaped, and include generally the tracks 44 and tracks 63 for receiving latch plates 65 and 66. The latch plate 65 is connected to the outside of the operator 40 and extends upwardly beyond the middle of the central latch unit 37. Vertical movement of the operator 40 is accompanied by a corresponding movement of the plate 65.

Figure 6:
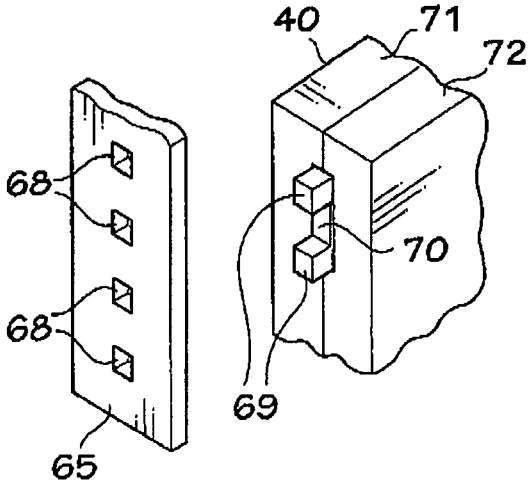
FIG. 6 is an exploded, isometric view of a portion of a bottom lock operator used in the locking post of FIG. 1.
Figure 7:
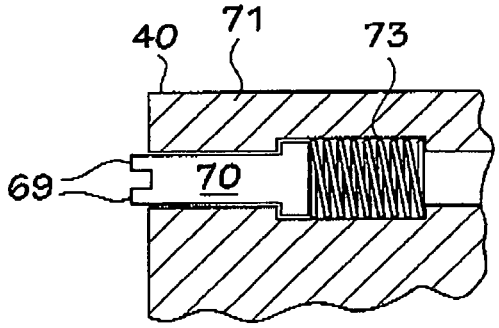
FIG. 7 is a longitudinal sectional view of a portion of the lock operator of FIG. 6.

As shown in FIG. 6, vertically aligned, square holes 68 are provided in the bottom end of the latch plate 65 for receiving square cross section fingers 69 on the outer end of a pin 70, which is slidable in the top end of the operator 40. The operator 40 is formed by two pieces 71 and 72 (FIG. 7) with cavities for receiving the pin 70 and a helical spring 73, which biases the pin 70 outwardly so that the fingers 69 remain in two adjacent holes 68 in the plate 65.

Figure 5:
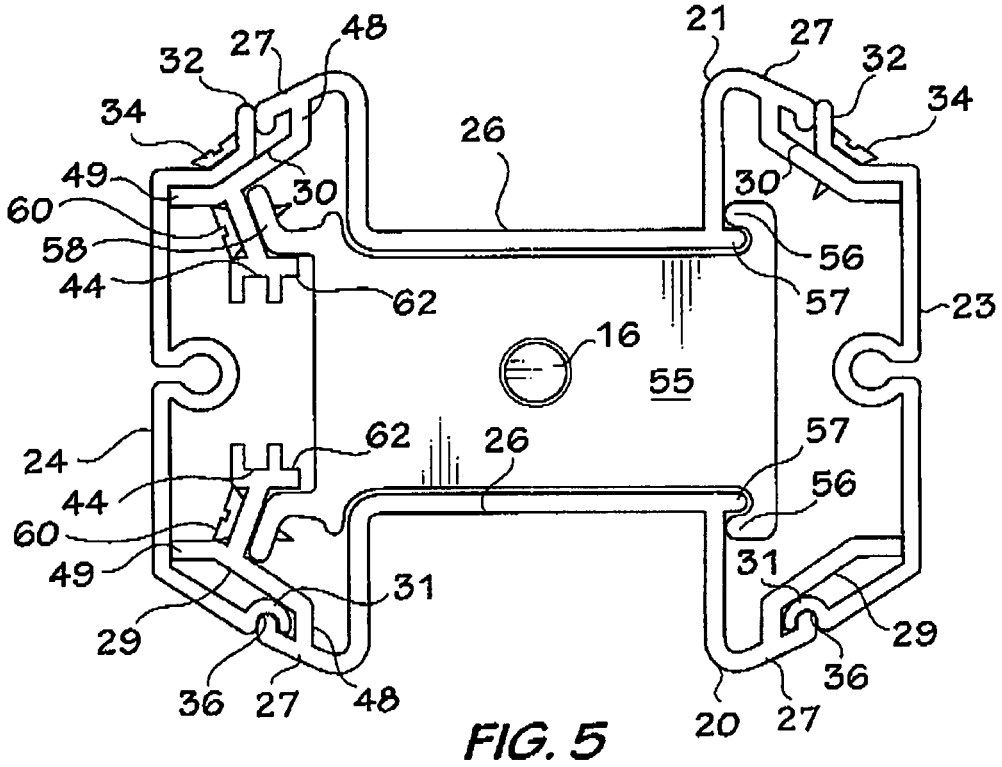
FIG. 5 is a bottom view of the locking post of FIG. 1.

As best shown in FIGS. 8 to 11, the latch unit 37 includes a housing 75 fixedly mounted in the tubular body 19 between two intermediate spacers 76 and 77 which are structurally the same as the spacer 55 (FIG. 5), except for the hole 56. The housing 75 contains a latch bar 79, which is slidable in a hole 80 in the wall 81 of the housing 75 facing the plate 65. A helical spring 82 extends from a cavity 83 in the inner end of the bar 79 to the wall 85 of the housing 75 opposite the wall 81. The spring 82 biases the bar 79 outwardly into the path of travel of the latch plates 65 and 66. The bar 79 is moved out of the path of travel of the plates 65 and 66 by unlocking one of a pair of cylinder locks 86 and 87, which are mounted in the inner and outer walls 20 and 21, respectively. A finger 88 is connected to the inner end of each of the locks 86 and 87 for engaging an arm 90 extending downwardly from the bottom of the inner end of the bar 79. When the locks 86 and 87 are in the unlocked condition, the fingers 88 bear against the arm 90 compressing the spring 82 to retain the bar 79 in a retracted position (FIG. 8) in which it abuts the upper latch plate 66. In this position of the bar 90, the plates 65 and 66 are free to move vertically.

The plate 66 is connected to the top bolt lock assembly 38 for movement between an extended upper, locked position and the lower unlocked position shown in FIG. 2. The top lock assembly includes a top operator 92 slidable in the tubular body 19. The connection between the plate 66 and the operator 92 is the same as the adjustable connection between the operator 40 and the plate 65. Downward movement of the operator 92 and the plate 66 is limited by a stop 93 formed by cutting two spaced apart slits in the plate 66 and bending the section of the plate between the slits out of the plane of the plate. A bolt 95 is mounted in and extends upwardly from the operator 92 through spacers 96 and 97 which are similar to the bottom spacer 55. The uppermost or top spacer 93 closes the top of the tubular body 19 and carries a trolley 9 for sliding in the rail 8 (FIG. 1).

Figure 8:
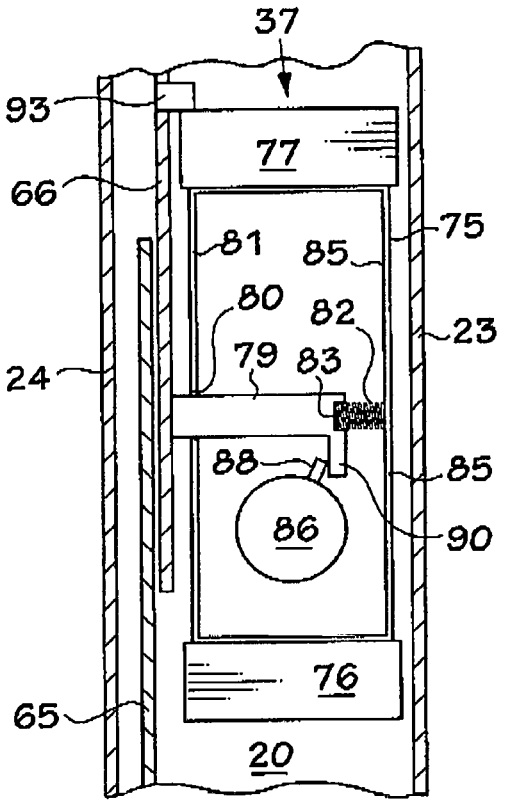
FIGS. 8 and 9 are longitudinal sectional views of a latch unit taken generally along line 6-6 of FIG. 2.
Figure 9:
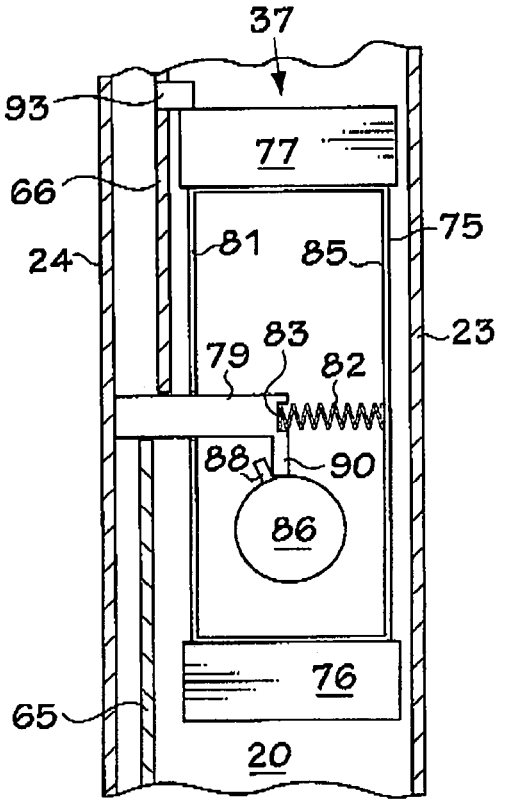
Figure 10:
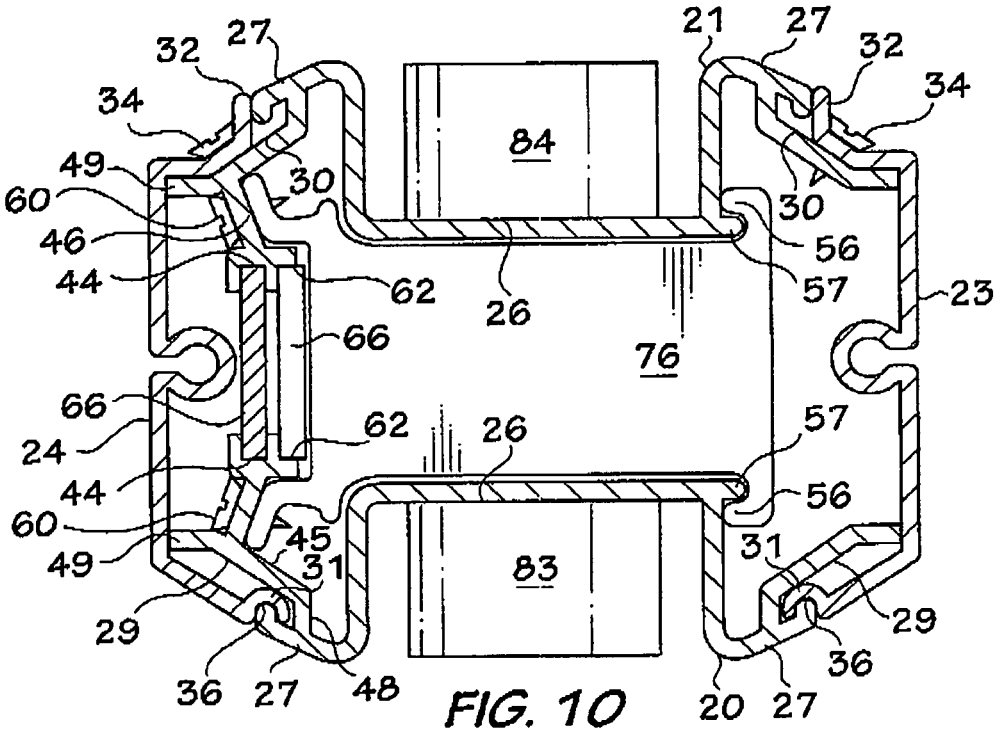
FIG. 10 is a cross section taken along line 10-10 of FIG. 2.
Figure 11:
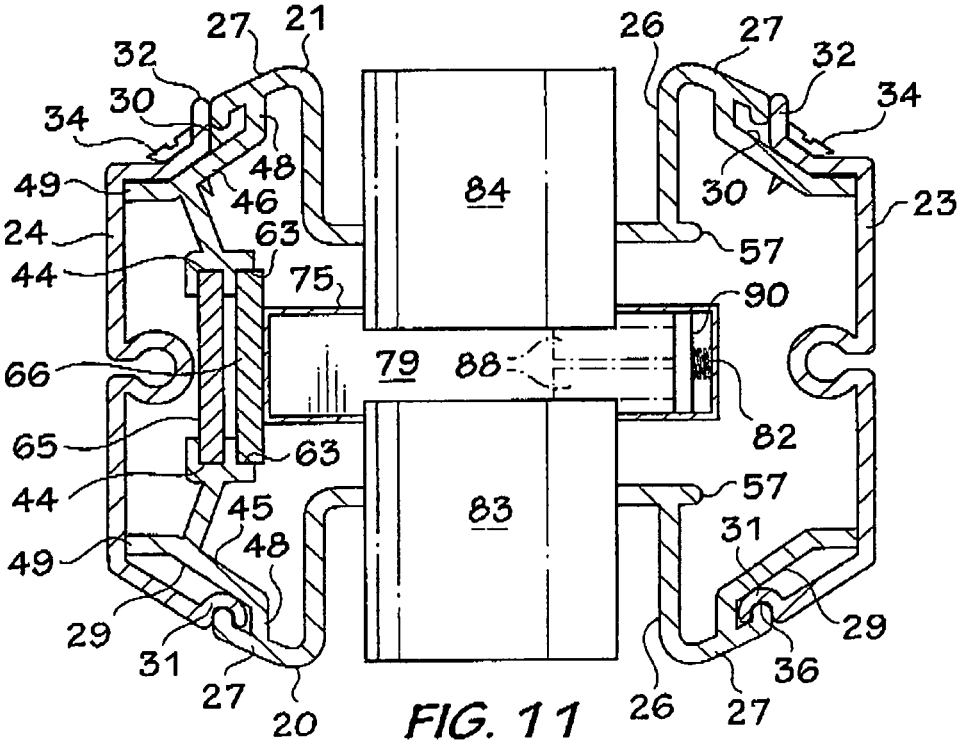
FIG. 11 is a cross section taken generally along line 11-11 of FIG. 2.

When the folding closure section 3 is in the open position, i.e. when the panels 7 are folded together, the latch bar 79 is in the retracted position shown in FIG. 8. When the closure section 3 is moved to the closed position shown in FIG. 1, the top operator 92 is pushed upwardly to cause the bolt 95 to enter a hole (not shown) in the top of the opening 4. Upward movement of the operator 92 is accompanied by corresponding upward movement of the plate 66. When the bottom of the plate 66 passes the top of the latch bar 79, the spring 82 pushes the bar into the path of travel of the plate 66, preventing downward movement of the plate 66, the operator 92 and the bolt 95. The operator 40 is then pushed downwardly which compresses the spring and causes the bolt to enter the hole 13 in the floor 14. The plate 65 moves with the operator 40. Once the top of the plate 65 passes the bottom of the plunger 79, the spring 82 pushes the latch bar 79 further out of the housing 75 into the path of travel of the plate. Thus, the plate 65 is latched into the locking position shown in FIG. 8, and the bolt 13 cannot be manually retracted from the floor. It will be appreciated that the post can be provided with only the bottom lock assembly 36.

When the floor 14 of the building is uneven, it may be necessary to adjust the length of the bolt sticking out of the tubular body 19 in the closed position. Adjusting of the bolt length is achieved by removing the side wall 24, depressing the pin 70 in the operator 40 to move the fingers 69 out of the holes 68 in the plate 65, moving the plate up or down, and releasing the pin 70 so that the fingers 69 enter a different pair of holes 68. For example, if there is a depression in the area of the floor 14 containing the hold 13, the plate 65 is moved upwardly relative to the operator 40 so that the fingers 69 enter lower holes 68. Thus, during locking of the lower lock assembly, the operator 40 and the bolt 16 can move downwardly a greater distance before the latch bar intersects the path of travel of the plate 65.

I claim:

1. A locking post for use on a free end of a folding closure section, said locking post comprising:

a tubular body having an inner wall, an outer wall and side walls extending between the inner and outer walls;

a bottom bolt lock assembly including a bottom lock operator slidable vertically in a bottom end of the tubular body, a handle connected to the operator and extending out of the inner or outer wall of the tubular body permitting manual movement of the operator, and a bolt extending downwardly from the operator for movement with the operator between a retracted position in the tubular body and an extended position into a hole in a floor beneath the closure section to lock the closure section in a closed, locked position, and a first spring on said bolt beneath said operator biasing the bolt to the extended position; and a latch unit in the tubular body for releasably latching the bolt in the extended position, said latch unit including a housing fixedly mounted in the tubular body above the bottom lock operator, a latch plate connected to one side of said operator and extending upwardly therefrom to a location beside said housing, a bar slidable in an opening in one wall of said housing between an extended position in which in extends into a path of travel of said latch plate when the operator is moved downwardly with the bolt to a locked position, thereby preventing vertical movement of the bolt out of the locked position, a cylinder lock extending through said inner or outer wall of the tubular body into said housing and a finger on said cylinder lock in the housing for retracting said bar to release the latch plate, permitting the spring to return the operator and bolt to the retracted position.

2. The locking post of claim 1 including a plurality of vertically aligned holes proximate a bottom end of said latch plate; a pin slidable in one side of said bottom operator, and at least one finger on an outer end of said pin for extending into selected of said holes permitting adjustment of the spacing between an upper end of the latch plate and the latch housing.

3. The locking post of claim 1 including a latch spring in said housing biasing said bar into the path of travel of said latch plate.

4. The locking post of claim 1, wherein said tubular body includes opposed partial partitions extending inwardly from said inner and outer walls, and two opposed tracks on inner ends of said partial partitions slidably supporting said operator and said latch plate in said tubular body.

5. The locking post of claim 4, including a bottom spacer closing a bottom end of the tubular body; a hole in said bottom spacer permitting sliding of the bolt in the bottom spacer; and intermediate spacers in the tubular body above the bottom end of the body for fixing the position of the latch housing in the tubular body.

6. The locking post of claim 5 including a pair of intermediate spacers fixedly mounted in the tubular body for retaining said latch housing in a fixed position in the tubular body.

7. The locking post of claim 6 including a top spacer closing the top end of the body; and a trolley mounted in said top spaces for sliding in a rail supporting the folding closure section.

8. The locking post of claim 1 including a handle extending from the operator out of each of said inner and outer walls of the tubular body.

9. A locking post for use on a free end of a folding closure section, said locking post comprising:

a tubular body having an inner wall, an outer wall and side walls extending between the inner and outer walls;

a bottom bolt lock assembly including a bottom lock operator slidable vertically in a bottom end of the tubular body, a bottom handle connected to the bottom operator and extending out of the inner or outer wall of the tubular body permitting manual movement of the bottom operator, a bottom bolt extending downwardly from the bottom operator for movement with the bottom operator between a retracted position in the tubular body and an extended position into a hole in a floor beneath the closure section to lock the closure section in a closed, locked position, and a first spring on said bottom bolt beneath said bottom operator biasing the bottom bolt to the extended position;

a top bolt lock assembly including a top lock operator slidable vertically in a top end of the tubular body, a top handle connected to the top operator and extending out of the inner or outer wall of the tubular body permitting manual movement of the top operator, a top bolt extending upwardly from the top operator between a retracted position in the tubular body and an extended position into a hole in a top of an opening containing the closure section to lock the closure section in the closed, locked position; and a latch unit in the tubular body for releasably latching the top and bottom bolts in extended positions, said latch unit including a housing fixedly mounted in the tubular body above the bottom lock operator, a bottom latch plate connected to one side of said bottom operator and extending upwardly therefrom to a location beside said housing, a top latch plate connected to one side of the top operator and extending downwardly therefrom to a location beside said housing and spaced apart from said bottom latch plate, a bar slidable in an opening in one wall of said housing for movement between an extended position in which it extends into a path of travel of said top and bottom latch plates when the bottom operator is moved downwardly with the bottom bolt to the extended position and the top operator is moved upwardly with the top bolt to the extended position, thereby preventing vertical movement of the top and bottom bolts out of the extended positions, a cylinder lock extending through said inner or outer wall of the tubular body into said housing; and a finger on said cylinder lock in the housing for retracting said bar to release the top and bottom latch plates, permitting the return of the top and bottom operators and the top and bottom bolts to the retracted position.

* * * * *